US005655783A

United States Patent [19]

Brosnan

[11] Patent Number: 5,655,783

[45] Date of Patent: Aug. 12, 1997

[54] ROLLER SKATE BRAKING DEVICE

[76] Inventor: Keller M. Brosnan, 3030 Regent St., #17, Berkeley, Calif. 94705

[21] Appl. No.: 221,648

[22] Filed: Apr. 5, 1994

Related U.S. Application Data

[63] Continuation-in-part of Ser. No. 839,543, Feb. 18, 1992, Pat. No. 5,299,815.

[51] Int. Cl.[6] ..... A63C 17/14

[52] U.S. Cl. ..... 280/11.2; 188/5

[58] Field of Search ..... 280/11.2, 11.19, 280/11.22, 11.25; 188/5

[56] References Cited

U.S. PATENT DOCUMENTS

| | | | |
|---|---|---|---|
| 225,361 | 3/1880 | French . | |
| 2,872,201 | 2/1959 | Wagers et al. | 280/11.2 |
| 4,033,596 | 7/1977 | Andorsen et al. | 280/11.2 |
| 4,099,734 | 7/1978 | Lowery | 280/11.2 |
| 4,167,225 | 9/1979 | Fragoso | 188/5 |
| 4,275,895 | 6/1981 | Edwards | 280/11.2 |
| 4,295,547 | 10/1981 | Dungan | 188/2 R |
| 4,453,726 | 6/1984 | Ziegler | 280/11.2 |
| 4,666,168 | 5/1987 | Hamill et al. | 280/11.2 |
| 4,807,893 | 2/1989 | Huang et al. | 280/11.2 |
| 4,817,974 | 4/1989 | Bergeron | 280/11.2 |
| 4,838,564 | 6/1989 | Jarvis | 280/11.28 |
| 4,892,332 | 1/1990 | Jennings | 280/842 |
| 4,909,523 | 3/1990 | Olson | 280/11.2 |
| 4,943,072 | 7/1990 | Henig | 280/112 |
| 5,088,748 | 2/1992 | Koselka et al. | 280/11.2 |
| 5,183,275 | 2/1993 | Hoskin | 280/11.2 |
| 5,211,409 | 5/1993 | Mitchell et al. | 280/11.2 |
| 5,253,882 | 10/1993 | Mitchell | 280/11.2 |
| 5,299,815 | 4/1994 | Brosnan et al. | 280/11.2 |
| 5,316,325 | 5/1994 | Mitchell | 280/11.2 |
| 5,330,207 | 7/1994 | Mitchell | 280/11.2 |
| 5,374,070 | 12/1994 | Pellegrini, Jr. et al. | 280/11.2 |
| 5,397,137 | 3/1995 | Pellegrini, Jr. et al. | 280/11.2 |
| 5,435,579 | 7/1995 | Pozzobon | 280/11.2 |
| 5,435,580 | 7/1995 | Balbinot et al. | 280/11.2 |
| 5,462,296 | 10/1995 | Pozzobon | 280/11.2 |

FOREIGN PATENT DOCUMENTS

| | | | |
|---|---|---|---|
| 0 379 906 A2 | 8/1990 | European Pat. Off. | 17/14 |
| 0 568 878 A1 | 11/1993 | European Pat. Off. | 17/14 |
| 0 585 764 A1 | 3/1994 | European Pat. Off. | 17/14 |
| 0 600 274 A 1 | 6/1994 | European Pat. Off. | 17/14 |
| 104127 | 4/1924 | Switzerland . | |

*Primary Examiner*—Joseph D. Pape
*Attorney, Agent, or Firm*—Stephen C. Shear

[57] ABSTRACT

A break for an in-line roller skate is disclosed, which is activated by rotating the skater's lower leg rearwardly to drive a friction pad downwardly to engage the skating surface. A locking device permits the friction pad to be locked in a braking position while the skater resumes the normal skating posture for manueuvring. The brake is released by lifting the skater's heel to permit the friction pad to return to a stowed position.

10 Claims, 5 Drawing Sheets

ROLLER SKATE BRAKING DEVICE

This application is a continuation in part of U.S. application Ser. No. 07/839,543, filed Feb. 18, 1992, now U.S. Pat. No. 5,299,815, granted Apr. 5, 1994.

FIELD OF THE INVENTION

This invention relates to brakes for small, foot-bound vehicles, including roller skates, roller skis and the like. It has particular application in in-line roller skates.

BACKGROUND OF THE INVENTION

In-line roller skates allow higher speeds to be attained than with conventional roller skates. Also, the lateral stability of in-line skates is less than with conventional roller skates. The brakes on in-line roller skates today generally consist of a static friction pad that the skater presses against the skating surface to slow forward speed. Such a braking system is inadequate. There is a need for a braking system that permits more effective braking than a static friction pad.

DESCRIPTION OF THE PRIOR ART

In our prior U.S. Pat. No. 5,299,815, a detailed description of the prior art is set forth. That description is incorporated here by reference as if set forth fully.

SUMMARY OF THE INVENTION AND OBJECTS

The present invention provides a means to deploy a brake behind the rear wheel of an in-line skate in order to apply a substantial amount of the skater's body weight to the brake. The brake when deployed extends a friction surface below the plane of the lowermost points of the wheels of the skate. In a preferred embodiment, the brake is deployed by flexing the leg of the skater in a rearward direction.

DESCRIPTION OF THE PREFERRED EMBODIMENTS

The present invention incorporates mechanical means to deploy a friction surface below the rearmost wheel of the skate. When braking is not desired, the friction surface is returned to its stowed position, ready for the next braking.

Figure 1:
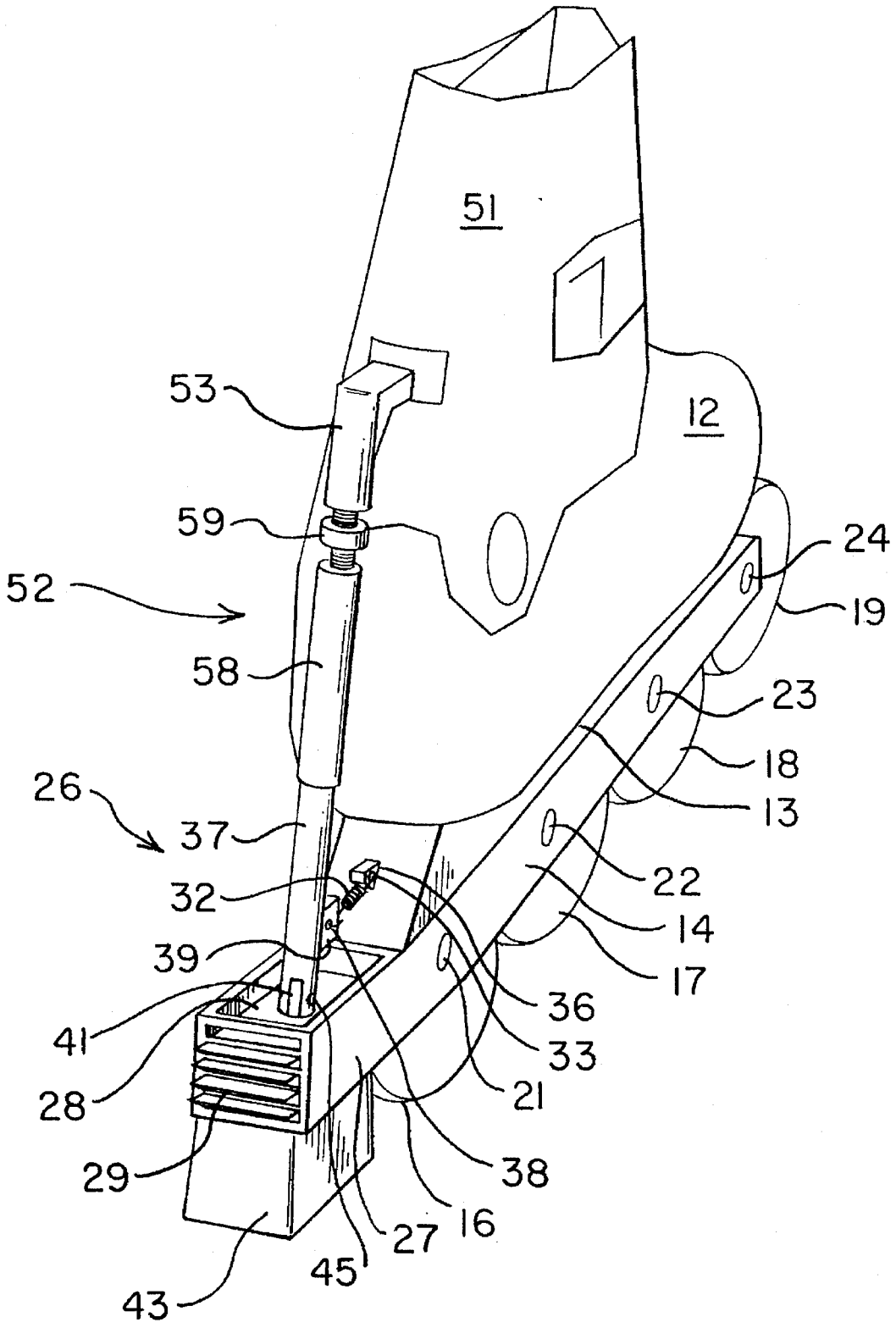
FIG. 1 is an isometric view of an in-line skate of this invention showing a brake in the stowed position.

Referring to FIG. 1, skate 11 includes a boot 12 on a platform 13 attached to the sole of the boot. Dependent from platform 13 is a wheel rack 14. Wheel rack 14 is a channel bearing a series of wheels 16, 17, 18 and 19. A larger or a smaller number of wheels may be used.

Wheels 16–19 are rotatably mounted on wheel rack 14 by any suitable means, such as axles, 21, 22, 23, and 24, respectively, support on either side of each wheel by rack 14. Each wheel 16–19 includes a roller surface, such as polyurethane, mounted on a wheel.

According to the present invention, a brake assembly 26 is mounted aft of the rearmost wheel(s) in order to transmit body weight most easily to the brake, allow maximum control for the skater, and minimize foot rotation in a vertical plane about the skater's ankle. While other locations for brake assembly 26 may be used, by far the preferred location is aft of the rear wheel, particularly with in-line roller skates. The skater's weight is preferably between the front wheel 19 and brake assembly 26.

Figure 2:
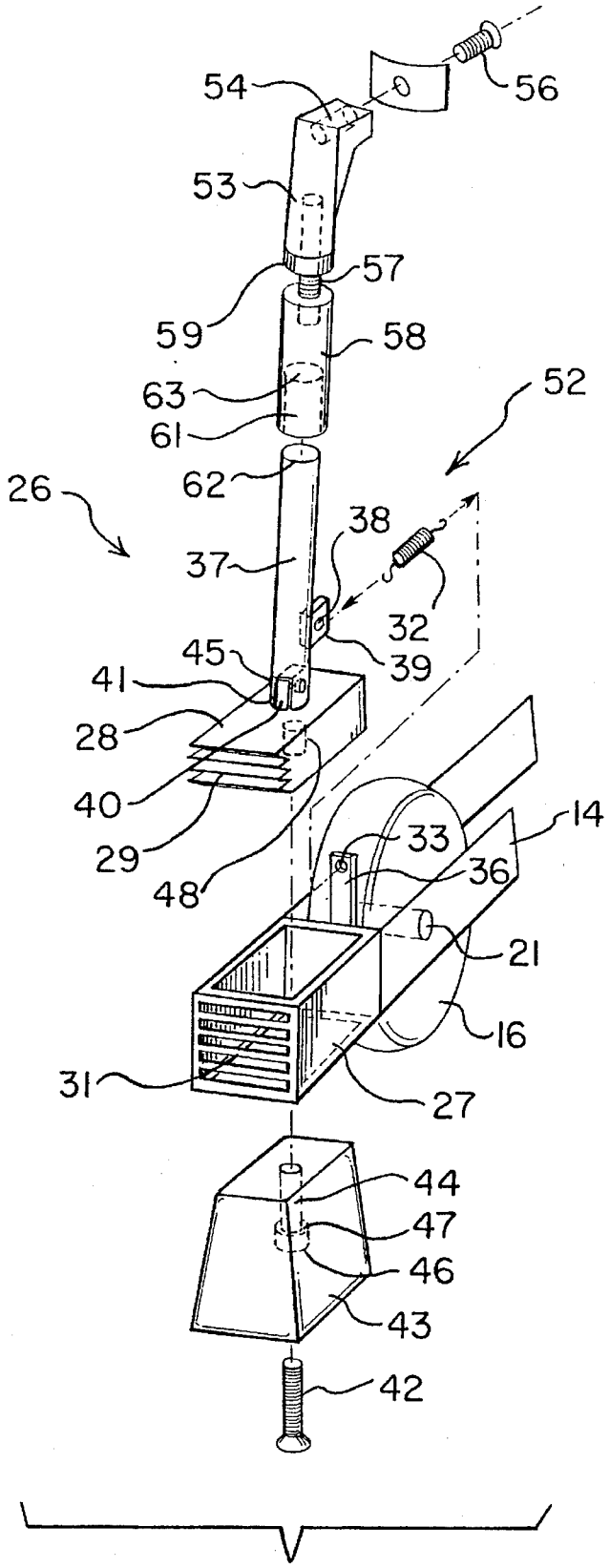
FIG. 2 is an exploded view, partially in section, of the brake assembly of FIG. 1.

FIG. 2 is an exploded view of brake assembly 26, partially in section. Brake assembly 26 consists of a housing 27, which may be conveniently mounted on axle 21 of rearmost wheel 16 so that it may rotate about the axle between an upper stowed position and a lower activated position. In FIG. 1, the stowed position is illustrated.

In FIG. 2, within housing 27 is a ratchet bar 28 having sloped teeth 29 on the rear surface. The teeth 29 are designed to engage pawl 31 on housing 27. Pawl 31 is shown as a series of openings in the back wall of housing 27 to accommodate teeth 29 of bar 28. Of course, the teeth and pawl may be reversed from that shown in FIG. 1, so long as only downward motion is permitted when teeth 29 engage pawl 31.

Other locking means may be substituted for the ratchet and pawl arrangement disclosed. Any detent that maintains the friction pad 43 in braking contact with surface 66 may be used.

Bar 28 is maintained out of contact with pawl 31 in the stowed position of FIG. 1 by means of spring 32, which urges bar 28 forward within housing 27. Other resilient means may be substituted for a spring. Spring 32 is attached to housing 27 at hole 33 in housing ear 36. The other end of spring 32 is attached to piston 37 at hole 38 in ear 39. Piston 37 is a rod having a lower end 41 which is internally threaded to engage screw 42. Screw 42 serves to secure friction pad 43 to ratchet bar 28. Pad 43 has a cylindrical hole 44 to accommodate the threads of screw 42, and a larger diameter concentric hole 46 formed to provide a shoulder 47 for the cap of screw 42 well inside the friction pad 43. In that way, pad 43 has a substantial erodible friction surface before reaching the cap of screw 42, at which time the friction pad 43 must be replaced.

Screw 42 is threaded into hole 48 in ratchet bar 28. Thus, screw 42 connects friction pad 43 to ratchet bar 28 to move as one element with respect to housing 27, which is attached to wheel rack 14. Wheel rack 14, in turn, is attached to boot 12.

Boot 12 preferably has a sleeve or cuff 51 encircling the ankle of the skater. Cuff 51 is movable in a fore and aft direction. When flexed toward the rear of the skate to a predetermined extent, cuff 51 serves to activate the brake assembly 26. Attached to the rear of the cuff 51 is a drive bar 52 which engages piston 37. Drive bar 52 comprises three parts: an upper segment 53, and adjustment means 57, and a lower segment 58. Upper segment 53 has a threaded recess 54 to cooperate with a flanged screw 56, which passes through cuff 51 to secure the cuff to the drive bar 52.

Segment 53 has at its lower end a threaded recess to engage adjustment screw 57. Screw 57 is threaded at both ends and has a gripping surface 59 for screwing in or out of either upper segment 53 or lower segment 58, or both. Screw 57 permits adjustment of the length of drive bar 52. Lower segment 58 has a hollow lower end 61 to accommodate piston 37. Piston 37 may slide up and down in sleeve end 61 to permit routine flexing of cuff 51 during skating. When the skater desires to brake, cuff 51 is flexed rearwardly to a sufficient extent to abut end 62 of piston 37 against the solid core surface 63 of lower segment 58, and thence drive all three elements of drive bar 52, ratchet bar 28, and friction pad 43 downward to engage skating surface 66 (FIGS. 3 to 7). The connection between drive bar 52 and ratchet bar 28 is a pin 45 engaging both piston 37 and ratchet bar 28. Ratchet bar 28 is a plastic block with a protrusion 40 molded into the top, adapted to fit into a U-shaped cut 41 in the lower end of piston 37. Pin 45 passes through one arm of cut 41, then through a hole (not shown) in protrusion 40, and then through the other arm cut into the end of piston 37.

The force of spring 32 holding ratchet bar 28 forward in housing 27 and away from pawl 31 is overcome by the flexing of cuff 51, so that when friction pad 43 touches the skating surface 66 (FIG. 4), it is immediately driven backward by the forward momentum of the skater to engage teeth 28 of ratchet bar 29 in pawl 31. Because the ratchet assembly can only move downward when engaged, and not up, friction pad 43 will continue to contact the skating surface until the brake is released.

Figure 4:
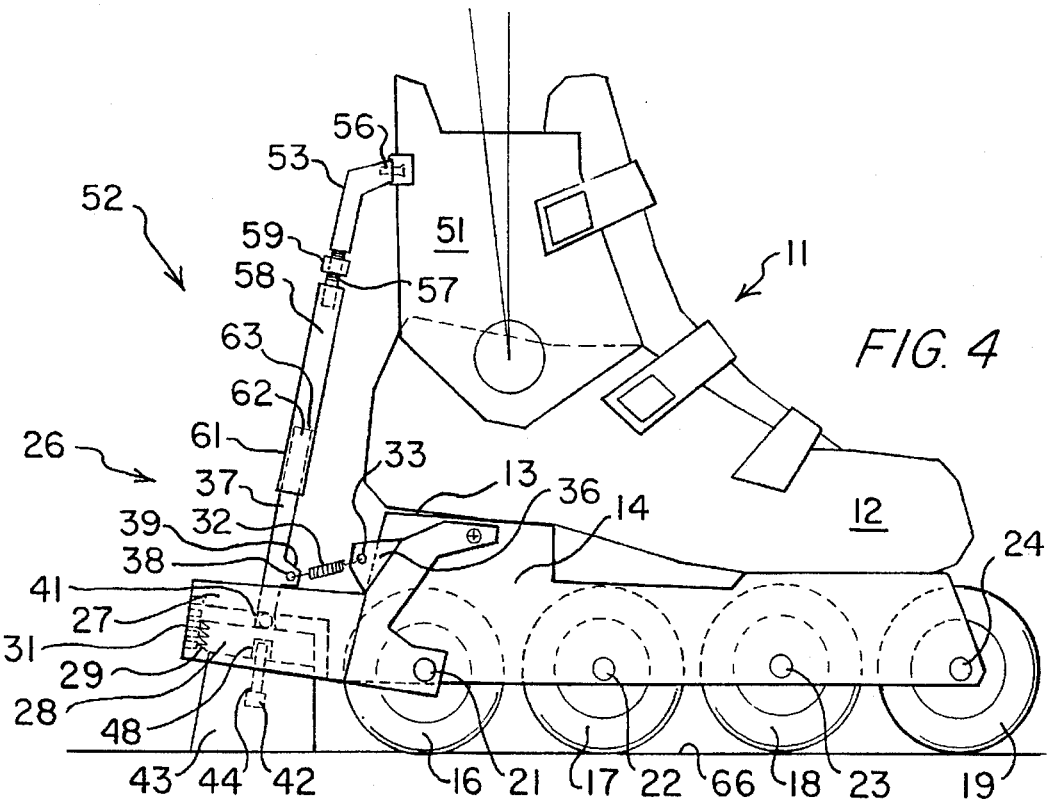
FIG. 4 is a side view of the skate of FIG. 3 showing the cuff of the boot flexed in a rearward direction.

FIG. 4 shows the activation of the brake by flexing the cuff 51 rearward so that friction pad 43 contacts the road surface 66. Ratchet bar 28 has engaged pawl 31 in housing 27.

Figure 5:
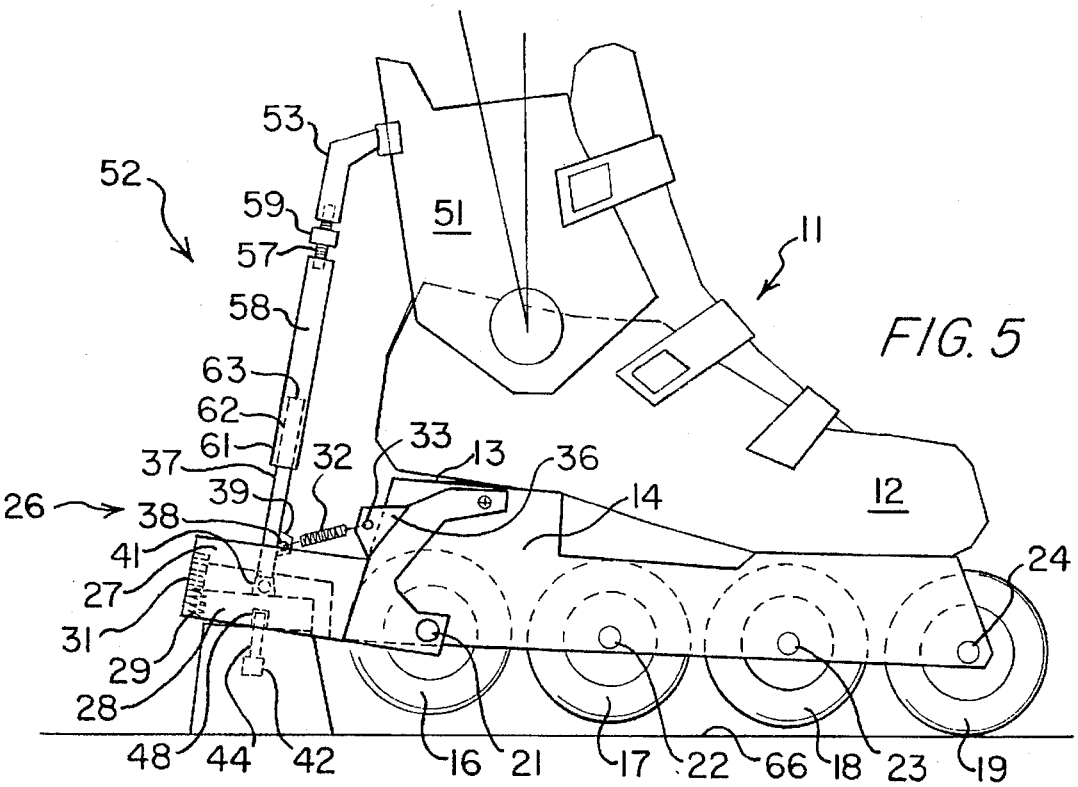
FIG. 5 is a side view of the skate of FIG. 3 with the brake friction pad ratcheted down to braking position below the plane formed by the lowermost points of the wheels of the skate.

FIG. 5 illustrates how braking can be increased by the skater increasing the amount of body weight applied to the friction pad 43. Pad 43 is ratcheted down so that the rear wheels are raised off the ground 66, and only the first one or two wheels, plus the friction pad 43, bear a substantial portion of the weight of the skater.

Figure 6:
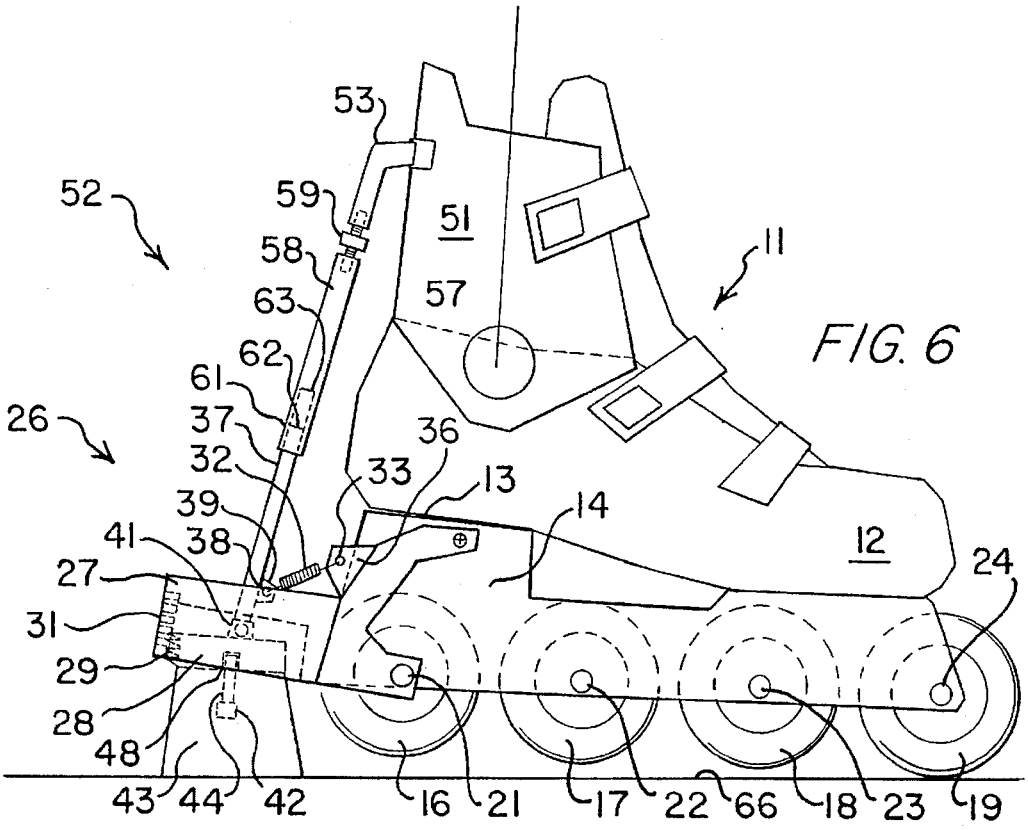
FIG. 6 is a side view of the skate of FIG. 3 with the skaters leg restored to skating posture while still braking.

Once the brake is ratcheted down to the desired braking level, the skater may straighten his leg, rotating the cuff forward as shown in FIG. 6. This gives better posture for the skater for maneuvering, such as executing a hockey stop, for example. Braking is at the desired maximum, yet the skater is in control of his movement and not off balance.

Figure 7:
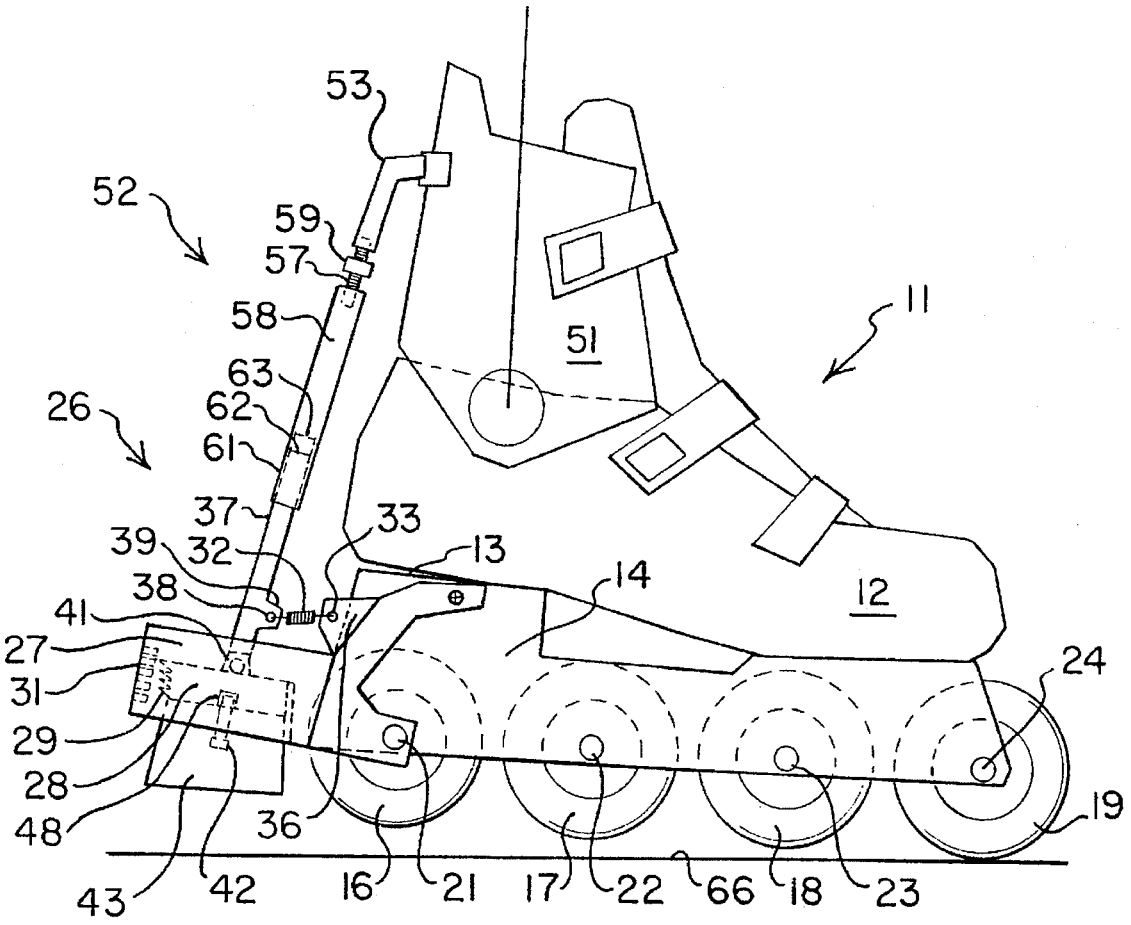
FIG. 7 is a side view of the skate of FIG. 3 with the skater's heel raised to disengage the brake.

FIG. 7 shows that the brake may be deactivated simply by lifting the heel of skate 11. When friction pad 43 is no longer in contact with road surface 66, spring 32 pulls ratchet bar 28 forward, disengaging teeth 29 from pawl 31, and returning the brake assembly 26 to the stowed position shown in FIG. 3.

Figure 3:
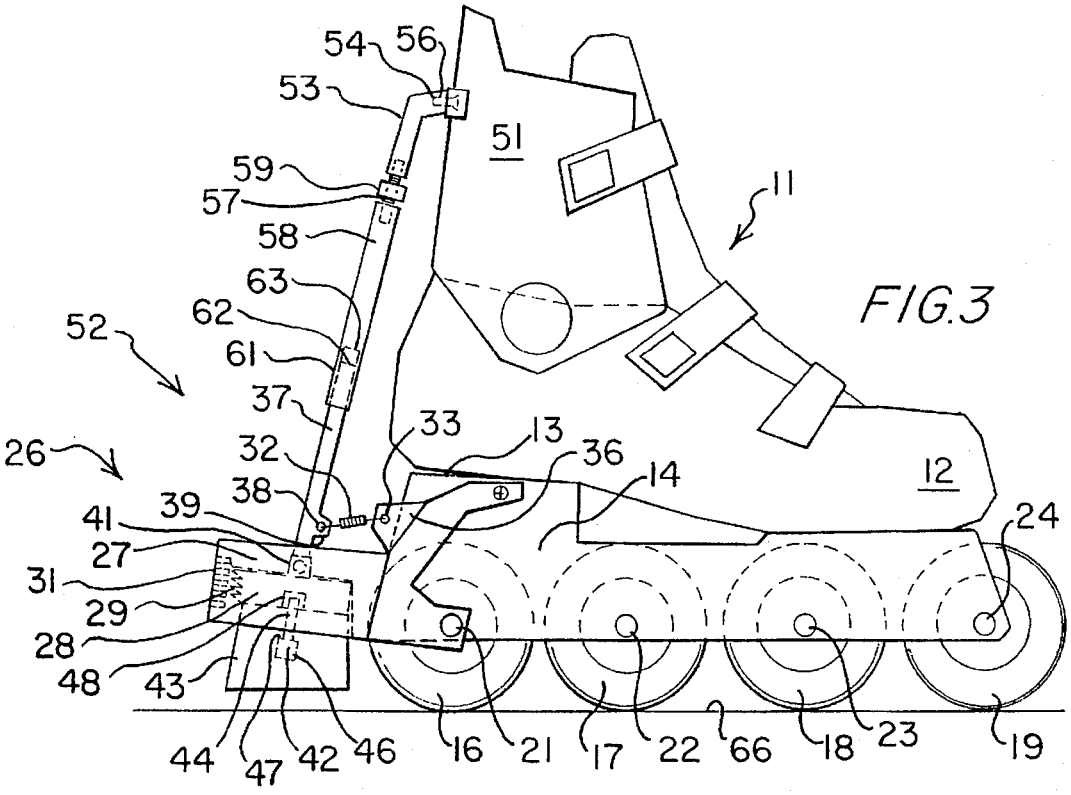
FIG. 3 is a side view of a skate with a brake assembly integrated with a wheel rack and in the stowed position.

In operation, the skater normally has the brake in the stowed position shown in FIG. 3. When the skater wants to slow down, he flexes his leg backward against cuff 51 of boot 12 so that drive bar 52 pushes friction pad 43 downward to engage road surface 66 as shown in FIG. 4. The skater then shifts the cuff further backward to the wider angle shown in FIG. 5 to ratchet down friction pad 43 to the braking position shown in FIG. 5. The brake remains engaged with road surface 66 even though the skater resumes normal skating posture with the skate vertically beneath the skater's body, as shown in FIG. 6, which allows more body weight to be applied to the pad 43. Even though forward momentum is slowing, the skater can maneuver the skate from a normal posture and need not be in an off-balance or awkward position while braking. The wheels of the skate may all be in contact with the skating surface 66.

When the forward momentum has been slowed to the desired degree, the skater may restore the brake to its stowed position simply by lifting the heel of the skate as shown in FIG. 7. Spring 32 draws the friction pad up into the stowed position.

It will be apparent that variations on the braking assembly will occur to those skilled in the art, and the foregoing embodiments are intended simply to illustrate the invention of the appended claims.

I claim:

1. A method of braking a roller skate bound to a skater's foot for skating on a surface, the method comprising the steps of: rotating the lower leg of the skater about the ankle pivot point, driving a friction member by said rotation against the surface being traversed said friction member being mounted at the back end of said skate, shifting a portion of the skater's weight against the friction member to slow forward momentum while at least the front wheel of the skate is in contact with the surface, and releasing the friction member from the surface when the forward momentum has slowed to the desired extent.

2. A method as in claim 1 wherein the friction member is locked in place against the surface so that braking takes place while the skater has freedom of movement of his leg.

3. A brake for a roller device bound to a skater's foot for skating on a surface, said device having at least one wheel forward of an aft wheel, said brake comprising: (a) a friction brake member movable between a stowed position above the plane formed by the lowermost points of the wheels and a braking position below said plane, and (b) an activation arrangement connected with said friction brake member and actuated in response to certain movement of the skater's leg to move the friction brake member from its stowed position to its braking position.

4. A brake as in claim 3 wherein at least the forward most wheel of the skate is in continuous contact with the skating surface while said braking member is in its braking position.

5. A brake as in claim 3 wherein a locking mechanism secures the friction member in the braking position.

6. An in-line roller skate assembly for skating on a surface, comprising: (a) a boot having a plurality of in-line wheels; and (b) a brake assembly including (i) a friction brake member and (ii) a mechanism connected with said boot at the back end thereof and supporting said friction member, said brake assembly being configured (1) to cause said friction brake member to contact said surface when the skater rotates his or her leg about an ankle pivot point which allows the skater to slow his or her forward momentum while at least the front wheel of the skate is in contact with the surface, and (2) to allow the skater to release the friction brake member from contact with the surface when desired.

7. An in-line roller skate device for use in skating on a given surface, comprising:

(a) a boot assembly configured to receive the foot of a skater;

(b) a plurality of spaced-apart, in-line wheels, all of which are rotatably mounted to the underside of the boot assembly; and (c) a brake assembly including a friction brake member and a mechanism supporting said brake member and connected with said boot assembly at the back end thereof, said brake assembly being configured such that the skater is able to move his or her leg in a way which causes said friction brake member to move relative to said boot assembly and said in-line wheels between (i) a first, non-braking position above said given surface so as to allow the skater to skate freely on said surface, and (ii) a second, braking position in contact with said given surface so as to slow down and/or stop the skater on said surface while the forward most one of said wheels is in contact with said surface.

8. A device according to claim 7 wherein said brake assembly is configured such that when said friction brake member is in said braking position, at least the rearward most one of said in-line wheels lies above and unconnected with said given surface, whereby the plane formed by the lowermost points of said wheels extends up from said surface and the friction brake member extends below the plane.

9. A device according to claim 7 wherein said boot assembly includes a boot and a wheel support arrangement connected with the underside of the boot and wherein said in-line wheels are rotatably mounted to said wheel support arrangement.

10. A device according to claim 9 wherein said supporting mechanism is connected to said wheel support arrangement and wherein said brake assembly is located behind and in line with said in-line wheels.

* * * * *